US005915582A

United States Patent [19]

Wawzonek

[11] Patent Number: 5,915,582

[45] Date of Patent: Jun. 29, 1999

[54] CONTAINER ASSEMBLIES

[76] Inventor: Stanley Wawzonek, R.R. #1, Jerseyville, Ontario, Canada, L0R 1R0

[21] Appl. No.: 08/710,659

[22] Filed: Sep. 23, 1996

[51] Int. Cl.[6] ..... B65D 43/02; B65D 23/12

[52] U.S. Cl. ..... 220/23.4; 215/382; 220/4.26; 220/23.83; 220/288; 220/669; 220/916; 220/DIG. 13; D9/335

[58] Field of Search ..... 220/288, 4.26, 220/4.27, 212, 608, 669, 670, 675, 674, 916, DIG. 13, 23.4, 23.6, 23.83, 23.86; 215/40, 382; D9/307, 335, 337, 341, 347, 520

[56] References Cited

U.S. PATENT DOCUMENTS

| | | | |
|---|---|---|---|
| D. 109,913 | 5/1938 | Guthrie | D9/335 |
| D. 164,327 | 8/1951 | Roehrich | D9/341 |
| D. 244,257 | 5/1977 | Godo et al. | D9/335 |
| D. 319,970 | 9/1991 | Beeman | D9/341 |
| D. 324,173 | 2/1992 | Lynd | D9/347 |
| D. 371,281 | 7/1996 | Credle, Jr. | D9/341 X |
| D. 381,900 | 8/1997 | Hundertmark et al. | D9/347 |
| 559,697 | 5/1896 | Gallagher | 220/916 X |
| 1,801,281 | 4/1931 | McEldowney | 220/23.86 X |
| 3,071,281 | 1/1963 | Shinichi Sawai | 220/916 X |
| 4,603,784 | 8/1986 | Chang | 220/916 X |

*Primary Examiner*—Stephen Castellano
*Assistant Examiner*—Niki M. Eloshway
*Attorney, Agent, or Firm*—Rogers & Scott

[57] ABSTRACT

A container assembly includes an elongated container having an elongated hollow body with opposite ends and a hollow externally screw-threaded cylindrical projection extending in a longitudinal direction from each opposite end, a short container having a squat hollow body with a hollow externally screw-threaded cylindrical projection extending from an end face thereof, and a tubular connector having opposite internally screw-threaded end portions.

6 Claims, 5 Drawing Sheets

CONTAINER ASSEMBLIES

BACKGROUND OF THE INVENTION

This invention relates to container assemblies which can be used as building components either on a toy scale or on a larger scale.

SUMMARY OF THE INVENTION

According to the invention, an elongated container has an elongated hollow body with opposite ends, and a hollow externally screw-threaded cylindrical projection extending in a longitudinal direction from each opposite end.

The elongated hollow body may have an end face at each opposite end with a central portion perpendicular to the longitudinal axis of the body and opposite side portions extending angularly rearwardly from the central portion, each screw-threaded projection extending from the central portion of the respective end face.

The elongated hollow body may have substantially parallel upper and lower faces extending between the central portions of the end faces, and outwardly curved side faces extending between respective opposite side portions of the end faces. The outwardly curved side faces may have the uneven appearance of a log.

Also in accordance with the invention a container assembly may include an elongated container as described above, a short container having a squat hollow body with a hollow externally screw-threaded cylindrical projection extending from an end face thereof, and a tubular connector having opposite internally screw-threaded end portions, one of the connector end portions being engaged with one of the screw-threaded projections of the elongated container and the other connector end portion being engaged with the screw-threaded projection of the short container. The end face of the squat hollow body of the short container may have a central portion and opposite side portions extending angularly rearwardly from the central portion. The squat hollow body of the short container may also have substantially parallel upper and lower faces and a substantially part-spherically shaped opposite end face extending between the upper and lower faces and between said opposite side portions of the first mentioned end face. The opposite end face of the squat hollow body of the short container may have the uneven appearance of a log.

On a small scale, both the elongated containers and the short containers can be provided with screw-threaded caps and used as drink containers for children. When such containers are empty, they can be used to build toy constructions. On a larger scale, and depending upon the actual scale, the elongated containers and the short containers can be used to build constructions of various kinds, such as buildings.

DESCRIPTION OF THE DRAWINGS

Embodiments of the invention will now be described, by way of example, with reference to the accompanying drawings, of which.

DESCRIPTION OF THE PREFERRED EMBODIMENT

Figures 1, 2, 3:
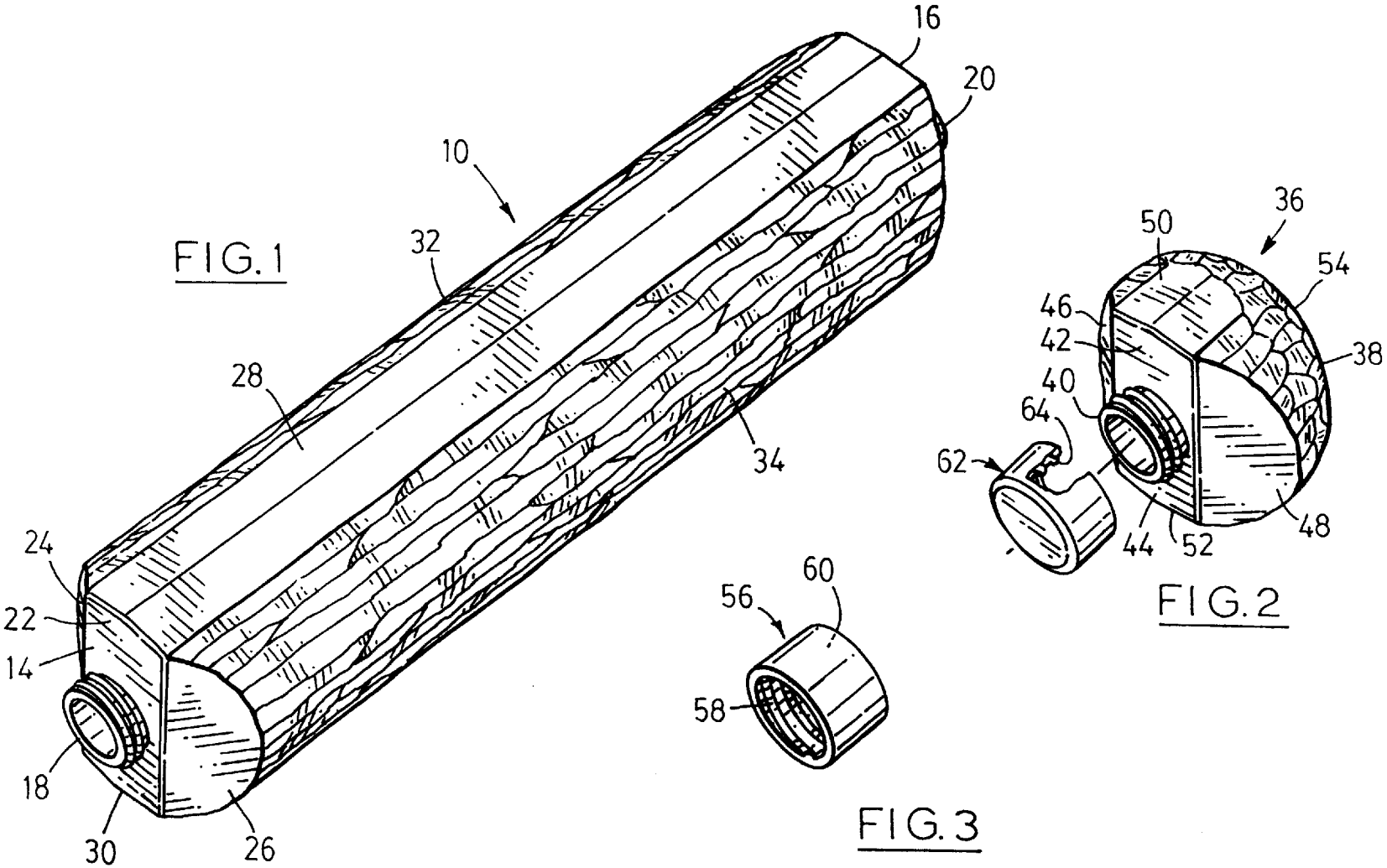
FIG. 1 is a perspective view of an elongated container in accordance with an embodiment of the invention.
FIG. 2 is a similar view of a short container in accordance with an embodiment of the invention.
FIG. 3 is a similar view of a tubular connector.

Referring to the drawings, FIG. 1 shows an elongated container 10 having an elongated hollow body 12 of plastic material with opposite end faces 14, 16, and an integral hollow externally screw-threaded cylindrical projection 18, 20 extending in a longitudinal direction from each opposite end 14, 16.

Each end face 14, 16 has a flat central portion 22 perpendicular to the longitudinal axis of the elongated body 12 and flat opposite side portions 24, 26 extending angularly rearwardly from the central portion 22, with the screw-threaded projections 18, 20 extending from the central portion 22 of each end face 14, 16.

The elongated hollow body 12 also has substantially parallel upper and lower faces 28, 30 extending between the central portions 22 of the end faces 14, 16, and outwardly curved side faces, 32, 34 extending between respective side portions 24, 26 of the end faces 14, 16. The outwardly curved side faces 32, 34 have the uneven appearance of a log.

FIG. 2 shows a short container 36 having a squat hollow body 38 of plastic material with a hollow externally screw-threaded cylindrical projection 40 extending from an end face 42. The end face 42 has a flat central portion 44 and flat opposite side portions 46, 48 extending angularly rearwardly from the central portion 44. The squat hollow body 38 also has substantially parallel upper and lower faces 50, 52 extending angularly rearwardly from the central portion 44 of the end face 42, and a substantially part-spherical opposite end face 54 extending between the upper and lower faces 50, 52 and between the opposite side portions 46, 48 of the end face 42. The opposite end face 54 of the squat container 36 has the uneven appearance of a log.

As shown in FIG. 3, a tubular connector 56 has opposite internally screw-threaded end portions 58, 60. Cylindrical end caps 62 with an internal screw-thread 64 are also provided.

When the elongated containers 10 and short containers 36 are provided on a substantially small scale, together with end caps 62, they can be used as drinking containers for children. After emptying, they can be used with tubular connectors 60 as building components in a manner which will now be described. When the elongated containers 10 and short containers 36 are provided on a larger scale, they can also be used with tubular connectors 60 in the manner which will also now be described.

Figures 4, 5:
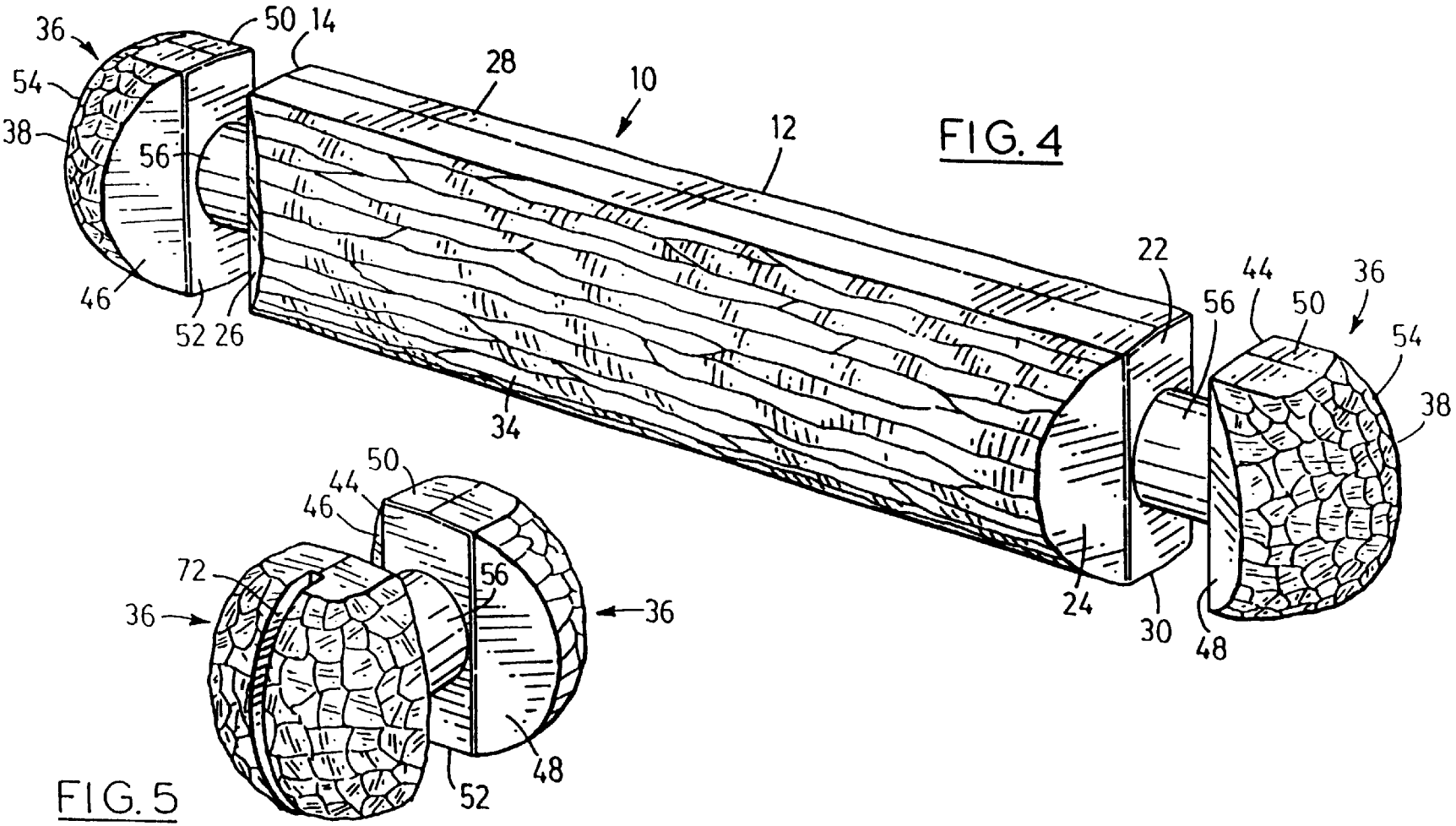
FIG. 4 is a similar view showing two short containers connected by tubular members to opposite ends of an elongated container.
FIG. 5 is a similar view of two short containers connected together by a tubular connector, and also showing a window groove in one of the short containers.

As shown in FIGS. 4 and 5, various container assemblies can be constructed. For example, as shown in FIG. 4, a first short container 36 can be connected to one end of an elongated container 10 by a tubular connector 56, with one screw-threaded end portion 58 of the connector 56 being screwed on to the projection 40 of the short container 36 and the other screw-threaded end of the connector being screwed on to the projection 18 at one end of the elongated container 10. Similarly, a second short container 36 can be connected to the other end of the elongated container 10 by a second tubular connector 56 in a similar manner. In each case, the upper and lower faces 50, 52 of the short containers 36 are aligned with the upper and lower faces 28, 30 of the elongated container 10, with the result that the central portions 22 and side portions 24, 26 of the end faces 14, 16 of the elongated container 10 are aligned with the central portions 44 and side portions 46, 48 respectively of the short containers 36. Similarly, as shown in FIG. 5, two short containers 36 can be connected together by a tubular connector 56, with similar alignment of the various faces.

Figure 6:
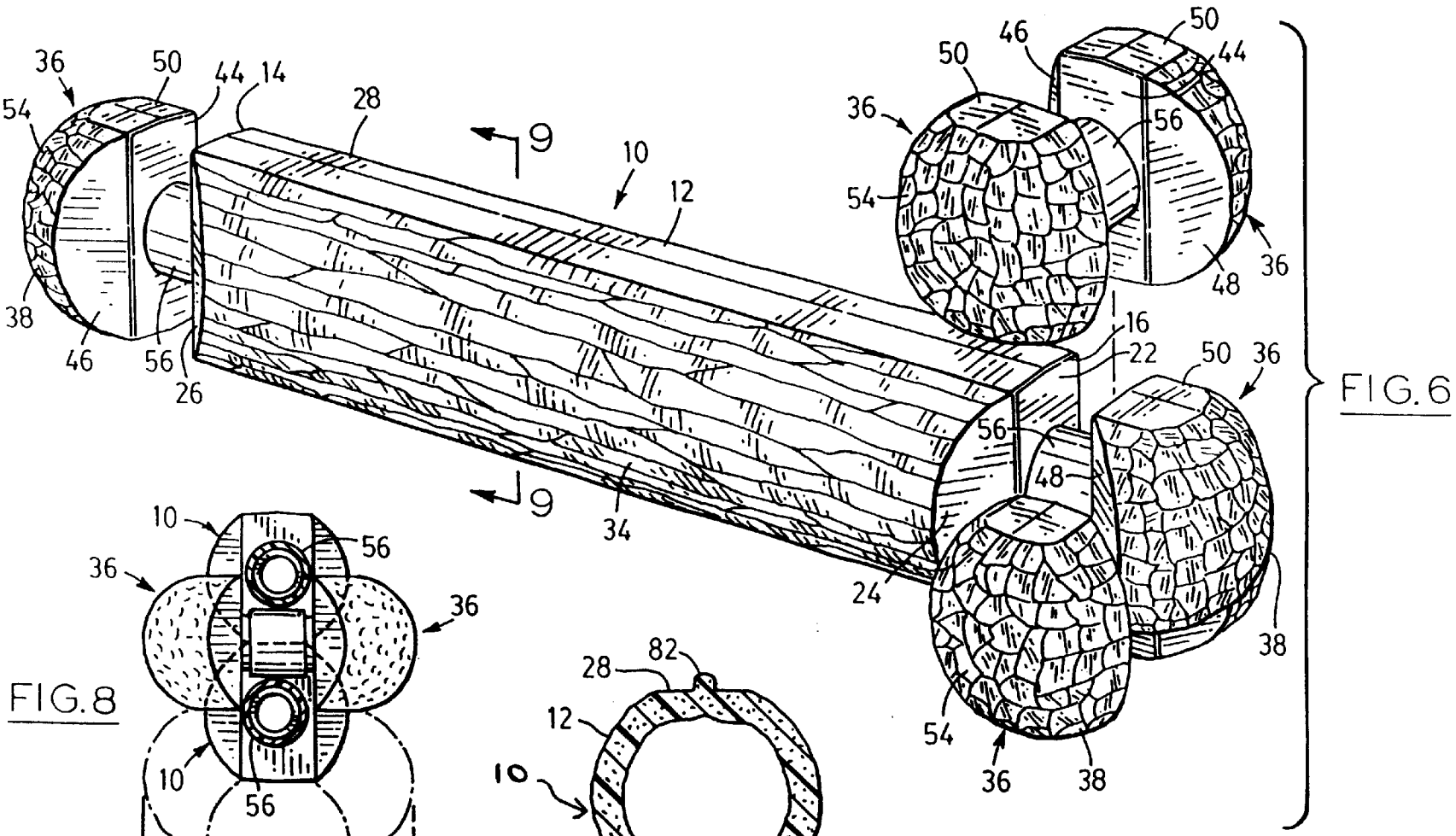
FIG. 6 is a side view of two pairs of connected short containers being interlocked with the assembly of FIG. 4.
Figure 9:
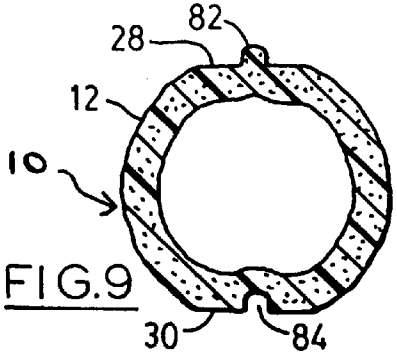
FIG. 9 is a sectional view along the line 9—9 of FIG. 6 but showing an alternative construction of elongated container.

FIG. 6 shows how constructions can be formed from assemblies of the kind shown in FIGS. 4 and 5. Two similar short containers 36 can be interlocked with one end of a long container/short container assembly by orienting the long container/squat container assembly perpendicularly to a first short container assembly and causing the tubular connector 56 of the long container/short container assembly to contact the tubular connector 56 of the first short container assembly (lowermost in FIG. 6) so that the side wall portions 46, 48 of the end faces 42 of each short container 36 slidingly engage the side faces 24, 26 and 46, 48 of the long container/short container assembly. The second short container assembly can then be placed on top of the first short container assembly so as to also become interlocked with the long container/short container assembly. It will also be readily understood that, if desired, two long containers 10 can be connected together by a tubular connector 56.

On a smaller scale, the long containers 10 and short containers 36 can be supplied as drinking containers for children, with the hollow screw-threaded projections 18, 20 or 40 being closed by caps 62. When a sufficient number of long containers 10 and short containers 36 have been emptied, various constructions can be made with the use of tubular connectors 56 also supplied.

Figure 8:
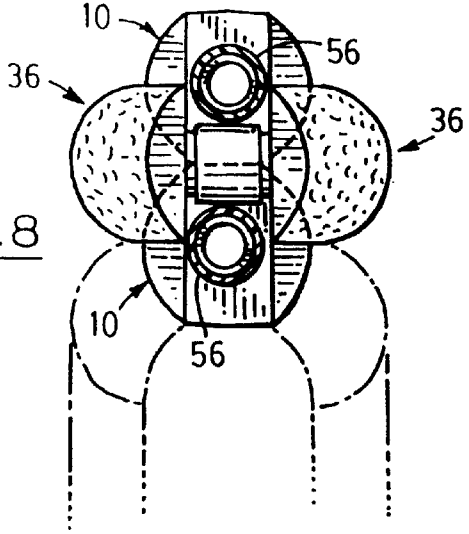
FIG. 8 is a sectional view along the line 8—8 of FIG. 7.
Figure 7:
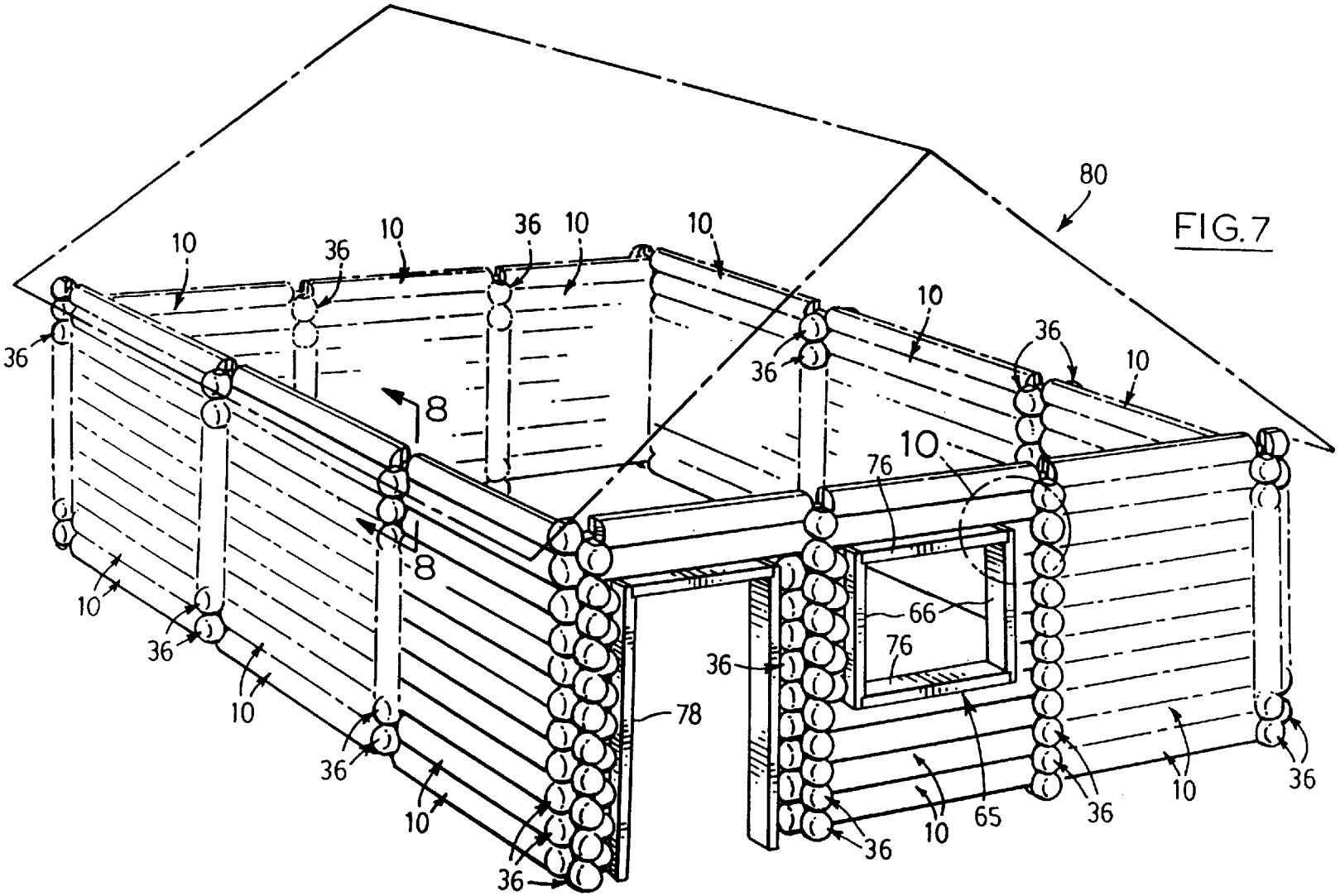
FIG. 7 is a similar view of a building with walls constructed with elongated containers, short containers and tubular connectors in accordance with an embodiment of the invention.
Figure 10:
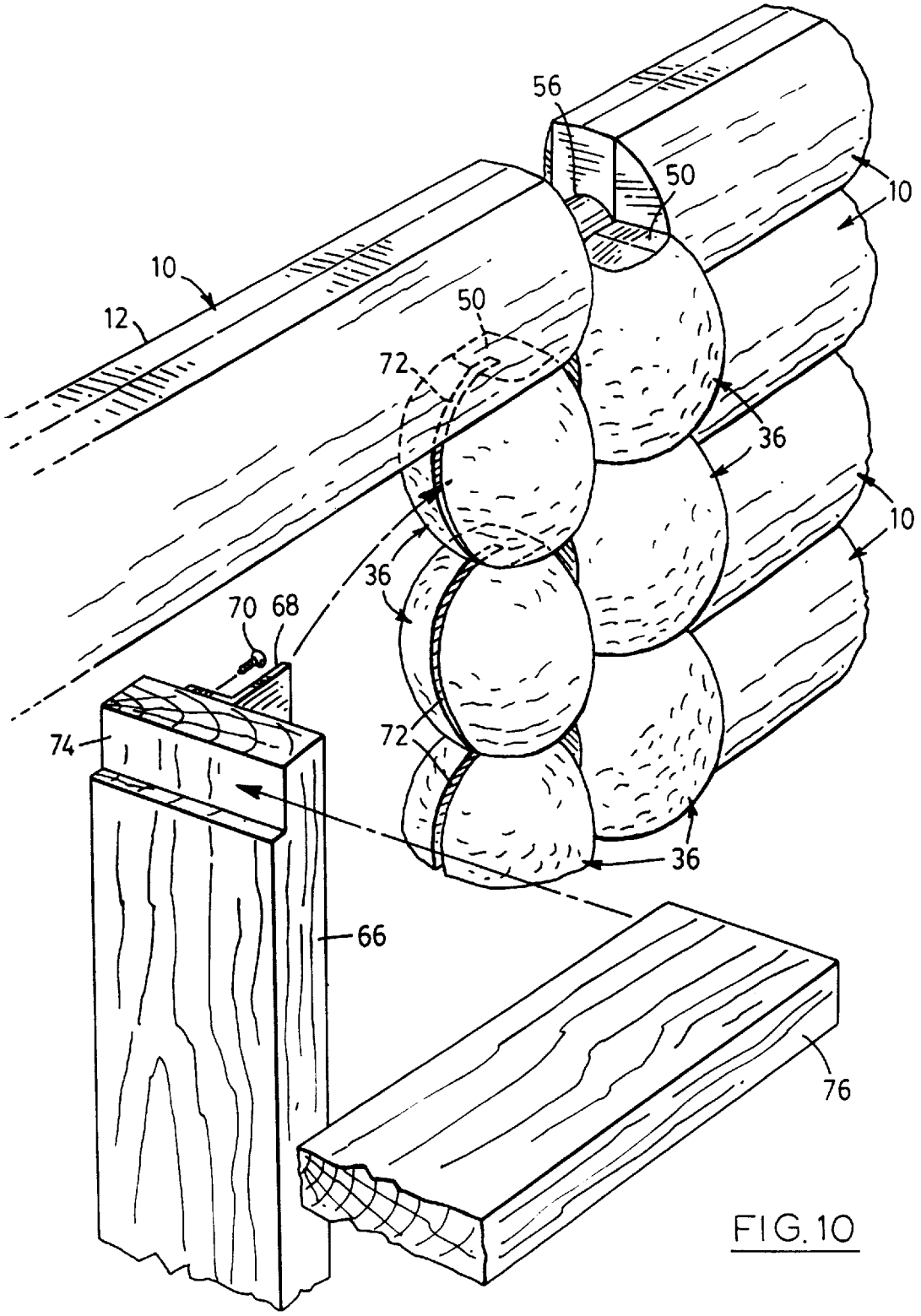
FIG. 10 is an exploded enlarged view of the area indicated by the circle 10 in FIG. 7.

On a larger scale, it is possible for example to construct the walls of a building in the manner shown in FIG. 7, 8 and 10. It is believed that the manner of construction will be readily apparent from the drawing and the previous description. A window frame 65 can be secured in place by providing the side frame members 66 with a length of angle iron 68 secured to the outer surface thereof by screws 70 and which fits into slots 72 provided in certain short containers 36. An upper window frame member 76 can rest in a recess 74 provided at the top of a side frame member 66. A door 78 can be secured in a similar manner and a roof 80 can be of any suitable construction. If desired, the upper and lower faces 28, 30 of the elongated container 12 may be provided with a longitudinally extending tongue 82 and a longitudinally extending groove 84 respectively for an interlocking fit when one elongated container 10 is placed on top of another.

Other embodiments will be readily apparent to a person skilled in the art, the scope of the invention being defined in the appended claims.

I claim:

1. A container assembly including an elongated container having an elongated hollow body with opposite ends and a hollow externally screw-threaded cylindrical projection extending in a longitudinal direction from each opposite end, the elongated hollow body of the elongated container having an end face at each opposite end with a planar central portion perpendicular to the longitudinal axis of the body and planar opposite side portions extending angularly from the central portion in a plane different from the plane of the central portion, each screw-threaded projection extending from the central portion of the respective end face, a short container having a squat hollow body with a hollow externally screw-threaded cylindrical projection extending from an end thereof, and a tubular connector having opposite internally screw-threaded end portions, one of the connector end portions being engaged with one of the screw-threaded projections of the elongated container and the other connector end portion being engaged with the screw-threaded projection of the short container.

2. A container assembly according to claim 1 wherein the elongated hollow body of the elongated container has substantially parallel upper and lower faces extending between the central portions of the end faces, and outwardly curved side faces extending between respective opposite side portions of the end faces.

3. A container assembly according to claim 2 wherein the outwardly curved side faces of the elongated hollow body of the elongated container have the uneven appearance of a log.

4. A container assembly according to claim 1 wherein the end face of the squat hollow body of the short container has a central portion and opposite side portions extending angularly rearwardly from the central portion.

5. A container assembly according to claim 4 wherein the elongated hollow body of the elongated container has substantially parallel upper and lower faces between the central portion of the end faces, and outwardly curved side faces extending between respective opposite side portions of the end faces, and the squat hollow body of the short container also has substantially parallel upper and lower faces and a substantially part-spherically shaped opposite end face extending between the upper and lower faces and between said opposite side portions of the first mentioned end face.

6. A container assembly according to claim 5 wherein the outwardly curved side faces of the elongated hollow body of the elongated container and the opposite end face of the squat hollow body of the short container have the uneven appearance of a log.

* * * * *